United States Patent [19]

Walter

[11] Patent Number: 4,753,320

[45] Date of Patent: Jun. 28, 1988

[54] CONVERTABLE STEP STOOL

[76] Inventor: Gary J. Walter, 5390 Echo Dell, NW., North Canton, Ohio 44720

[21] Appl. No.: 41,110

[22] Filed: Apr. 22, 1987

[51] Int. Cl.[4] ..... A47C 3/18; A47C 9/00; A47C 13/00

[52] U.S. Cl. ..... 182/33; 182/46; 182/91

[58] Field of Search ..... 182/91, 92, 33–33.6, 182/46

[56] References Cited

U.S. PATENT DOCUMENTS

| | | | |
|---|---|---|---|
| 139,488 | 6/1873 | Willgohs | 182/33 |
| 1,820,904 | 9/1931 | Beck | 182/33 |
| 2,584,642 | 2/1952 | Tuttle | 182/33 |
| 2,592,912 | 4/1952 | Knipper | 182/33 |
| 2,666,210 | 1/1954 | Wiley | 182/33 |
| 2,675,058 | 4/1954 | Meagher | 182/33 |

*Primary Examiner*—Reinaldo P. Machado
*Attorney, Agent, or Firm*—Woodling, Krost & Rust

[57] ABSTRACT

A stool with two major parts is disclosed. One way of fastening the parts together yields a rigid free-standing stool. In the alternate configuration a folding stool is formed, which can be fastened to the interior of a base cabinet so that the platform part can be pulled out and used by a child.

2 Claims, 4 Drawing Sheets

CONVERTABLE STEP STOOL

This invention relates to furniture. In particular, it relates to small step stools convertible to more than one configuration.

BACKGROUND AND SUMMARY OF THE INVENTION

Small step stools are commonly needed in households, most of which contain at least a few storage areas located too high from the floor for easy access. In particular, when there are small children present in the home, such stools may be needed in areas such as bathrooms and other sink or counter facilities to render such facilities accessible while the children are growing up. Such a stool should ideally be able to be moved easily to and from the floor in front of a sink so that the area can also be used by the persons of normal height. In addition, it must of course be entirely stable against sidewise motion while in use.

An ordinary short stool, with its legs cut to the necessary height, may be employed. It must, however, be transported to and from the site of use, and may not be stable enough for a very young child. One kick stool, of known design, is easy to transport because it rolls readily across the floor with a kick and becomes stable when stepped upon. However, it occupies space on another area of the floor, which can be a problem in small quarters such as a bathroom.

The present invention obviates these difficulties. It is a stool which has two major parts. By reassembling the parts it can be used either as a free-standing stool of traditional design and useful height, or instead, as a folding stool. When in the folding stool configuration, one part is fastened to the lowest shelf in the typical sink cabinet while the other part, pivoting outward from the first part, can be pulled out by a child for temporary use as a stool. The vertical relationship between the parts is adjustable for adapting the device to the cabinet shelf height. When the child has grown to the point that the folding stool is unnecessary at the sink or counter, it may be removed altogether from its mounting in the cabinet, and reassembled easily into the free-standing configuration for general household use, or for the child's use in reaching high shelves.

Accordingly, it is an object of the invention to provide a supporting stool for lifting a small child to the necessary level for use of a sink or countertop atop a base cabinet.

A further object of the invention is to provide such a stool which is stably mounted against sidewise motion but which can easily be moved away from the standing site so the area can be used by others.

Another object of the invention is to provide such a stool which may be converted into a single free-standing step stool when no longer needed at the cabinet.

Other objects and a fuller understanding of the invention will be apparent from the claims herein, the accompanying specification, and the description to follow of a preferred embodiment taken together with the figures, in which:

FIG. 1 a perspective drawing of the stool of the present invention, assembled or configured as a free-standing step stool.

Figure 1:
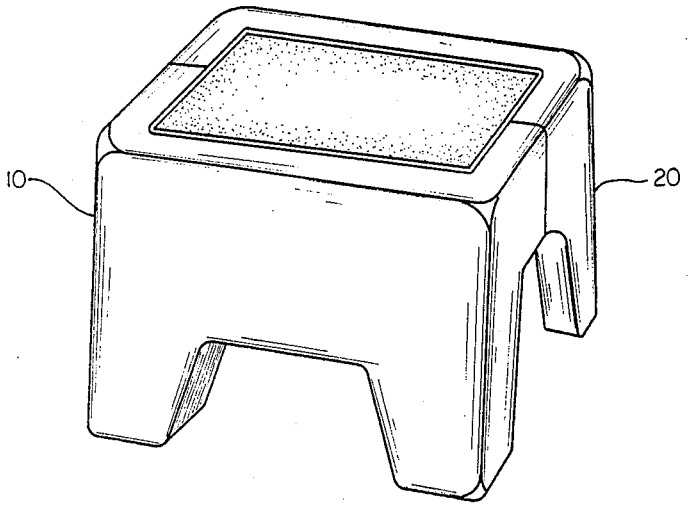
Figure 2:
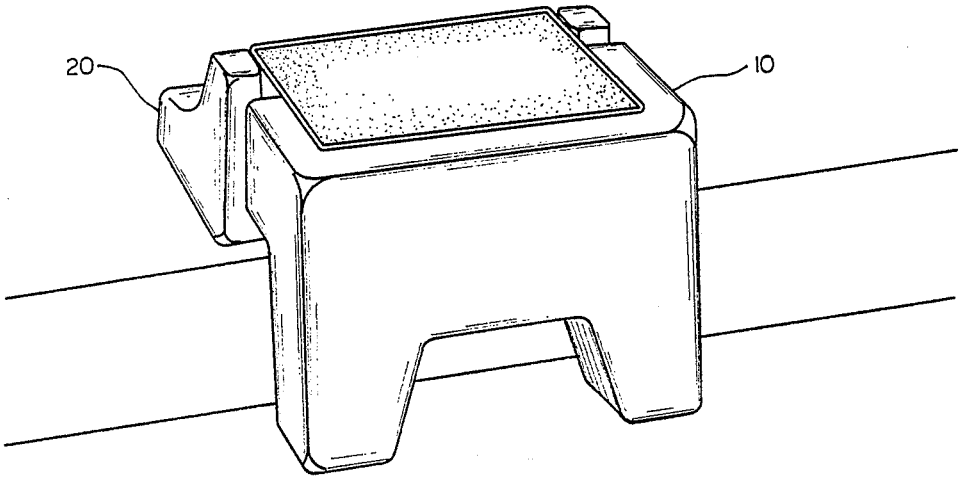
FIG. 2 is a perspective drawing of the stool configured as a fixed folding step stool.
Figure 9A:
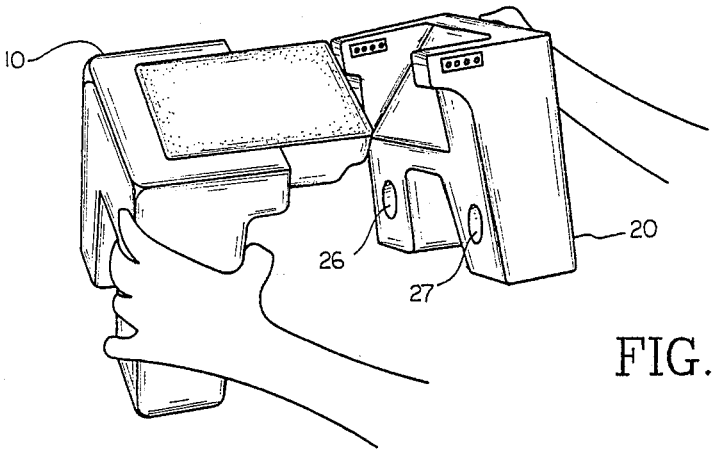
Figure 9B:
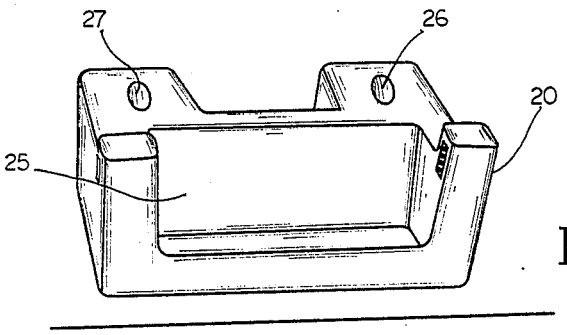
Figure 9C:
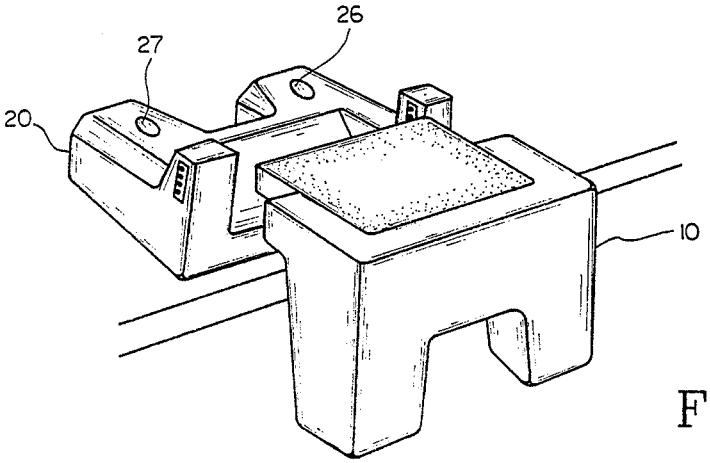

FIGS. 9*a*, 9*b* and 9*c* are perspective views showing the disassembly of the configuration of FIG. 1 and the stool's reassembly into the configuration of FIG. 2.

DESCRIPTION OF THE PREFERRED EMBODIMENT

FIGS. 1 and 2 show in perspective the two ways of configuring the parts of the present invention. In FIG. 1, a free-standing stool is shown, and in FIG. 2 a folding stool which has a supporting member attached to a step or the lowest shelf of a cabinet.

Figure 3:
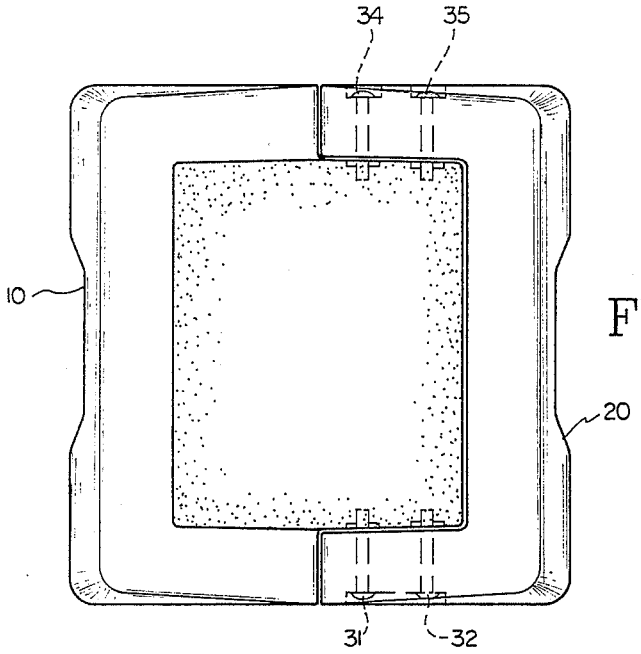
FIG. 3 is a plan view of the stool of FIG. 1.
Figure 4:
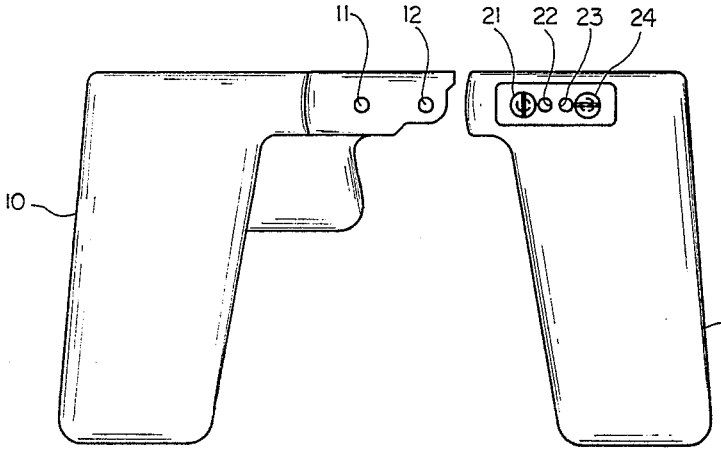
FIG. 4 is a side elevational view of the same stool, exploded into its two major parts.
Figure 5:
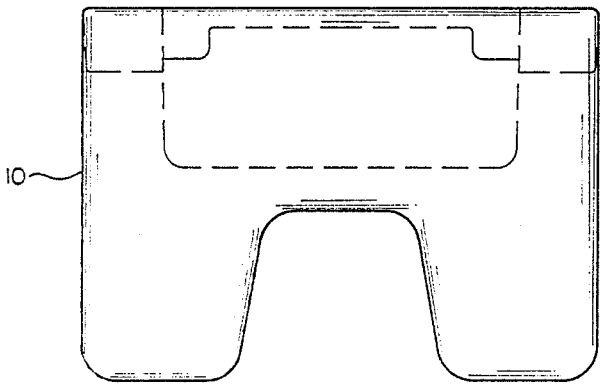
FIG. 5 is a front elevational view partly in phantom section, of the same stool.

The free-standing stool of FIG. 1 as also seen in FIGS. 3, 4, 5 and 9*a* comprises two essential parts. As best seen in FIGS. 3, 4 and 9*a*, a platform member 10 is supported by an interlocking supporting member 20, by means of four ¼ inch machine screws 31, 32, 33 and 34. The fastening means could of course be any similar means such as bolts, or could comprise instead two long fasteners extending through the platform member 10. Screw 31 is inserted through hole 11 in platform member 10 and hole 21 in supporting member 20, screw 32 through holes 12 and 24, and similarly on the other side, not shown. As best seen in FIGS. 8, 9*a*, 9*b* and 9*c*, supporting member 21 is provided with recesses 25, 26 and 27 to permit interlocking and enable it to be fastened to a shelf by screws.

Figure 6:
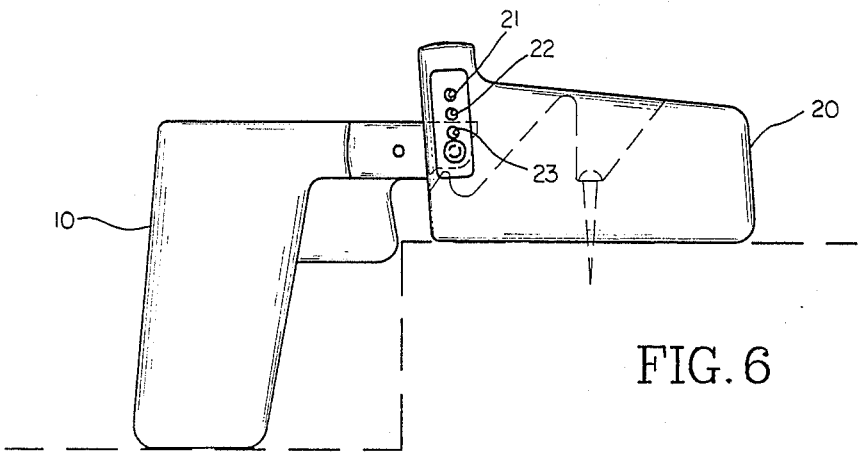
FIG. 6 is a side elevational view of the stool as configured in FIG 2.
Figure 7:
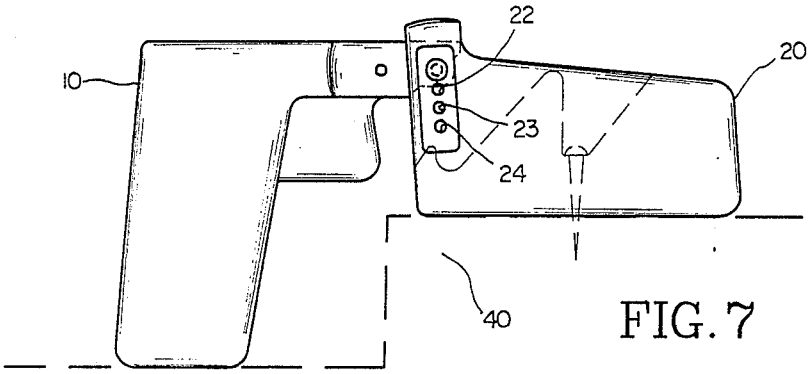
FIG. 7 is another side elevational view, partly in phantom section, of the stool as configured in FIG. 2, except that the assembly is adjusted with a different vertical relationship between the members.

The folding stool configuration shown in FIG. 2 is shown in more detail in FIGS. 6, 7, 8 and 9*c*. In this configuration the supporting member 20 has been inverted with respect to platform member 10, and rotated through ninety degrees. It has been fastened to a shelf 40, and then screwed to platform member 10 through hole 12 and the corresponding hole on the other side. FIGS. 6 and 7 illustrate two versions of this configuration, differing only by the choice of which of holes 21, 22, 23 or 24 on supporting member 20 is selected for assembly to platform member 10. This choice will be determined by the height of shelf 40 from the floor.

This reconfiguration is best seen in FIGS. 9*a* through 9*c*. The conversion to a folding stool is easily effected by removing the four screws 31 through 34 and separating the members as shown in FIG. 9*a*. The supporting member 20 is inverted and its desired position on the base counter shelf marked with a pencil through holes in its outer wall. These holes may be provided in the supporting member at manufacture, but it is preferred to mold indents into the member, which indents are used to located holes drilled just before installation. Generally a clearance of ½ inch between the edge of shelf 40 suffices to permit closing of the cabinet door, but this will be adapted according to the cabinet itself in an obvious manner.

Figure 8:
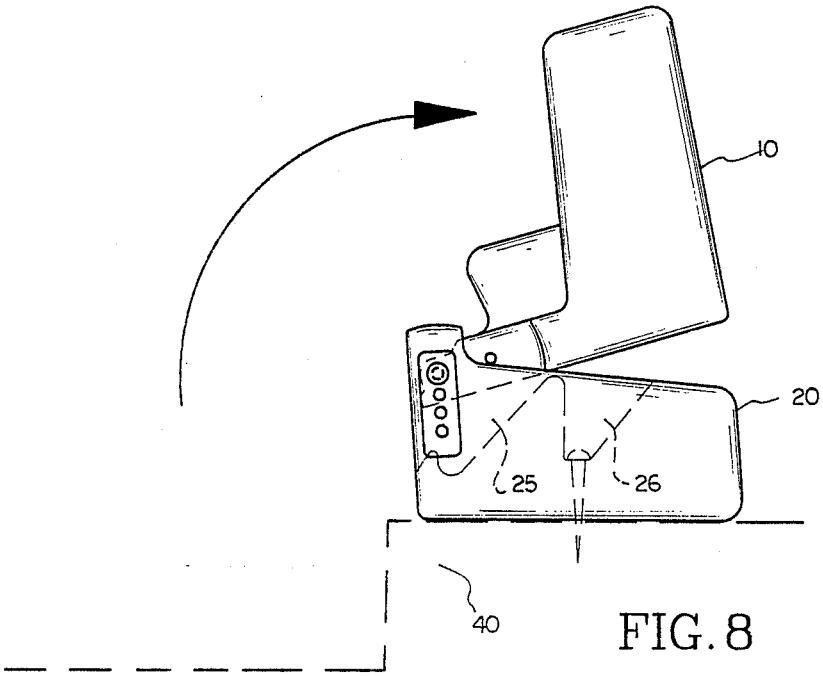
FIG. 8 is a further side elevational view of the stool of FIG. 7, shown in the folded portion.

When supporting member 20 is screwed to shelf 40, the one of holes 21, 22, 23 or 24 is chosen which best levels platform member 10 with the floor. It has been found that holes about ½ inch apart will suffice for adequate leveling in the preferred embodiment. Each side is fastened with one screw, tightened enough to hold securely but just loose enough to permit pivoting of the members 10 and 20 with respect to each other. FIG. 8 shows the step stool in the closed position.

In the preferred embodiment, the members are blow-molded plastic with an average wall thickness of 0.08" to 0.10". The height of the platform member, which is slightly domed on top for strength, is 8.7 inches from the floor. A 3 ¾ inch space between the legs on each member provides a convenient handle area for easy lifting of the stool, or pivoting of the platform member when in the second configuration. A rubber foot is securely screwed to the bottom of each leg to help prevent slipping when the stool is in the free-standing form. As seen best in FIGS. 6, 7, 8 and **9*b*, recesses are provided for easy clearance during the marking, drilling and mounting operations. In the preferred embodiment, screw holes 21 through 24**, and their counterparts on the other side of the supporting member, are contained in a separate insertable molded plastic member provided with an integral plastic flap or "living hinge" for best appearance.

The principal use for the folding step stool will be as described, for supporting a child at a convenient height from the floor in front of a base cabinet. It will of course be recognized, however, that the same kind of arrangement will suffice to hold any object away from a first horizontal surface, where there is a second surface present to which the supporting member may be fastened. The essential point of the invention is its re-configurability between the free-standing and the fastened down, but folding, forms of the stool.

The invention has been described in detail with particular emphasis on the preferred embodiments thereof, but it should be understood that variations and modifications within the spirit and scope of the invention may occur to those skilled in the art to which the invention pertains.

What is claimed is:

1. Apparatus for supporting a weight away from a first horizontal surface, comprising a platform member having a generally horizontal platform adapted to bear said weight and extending from said platform to said first surface;

a supporting member attachable to said platform member in either a first or a second configuration, said attachment in said first configuration being rigid and said attachment in said second configuration being through a pivot joint; said supporting member extending to said first surface when attached in said first configuration;

means to fasten said supporting member rigidly to a second surface when it is attached to said platform member in said second configuration;

said platform member being adapted to be drawn by means of said pivot joint towards said second surface when said supporting member is fastened to it.

2. A step stool comprising a platform member and a supporting member, said platform member having a right and a left platform side, and having a right platform hole and a left platform hole on said right and left platform sides, respectively;

said supporting member having a right and a left supporting side, and having a right supporting hole and a left supporting hole on said right and left supporting sides, respectively;

screw means for rigidly connecting said platform member to said supporting member, through said right platform hole and right supporting hole and through said left platform hole and said left supporting hole, to form a free-standing stool; and screw means for pivotally connecting said platform member to said supporting member, through said right platform hole and said left supporting hole and through said left platform hole and said right supporting hole, to form a folding stool.

* * * * *